US009499991B2

(12) United States Patent
Preston

(10) Patent No.: US 9,499,991 B2
(45) Date of Patent: Nov. 22, 2016

(54) STAIR MODULES WHICH CO OPERATE TO FORM A TEMPORARY STAIR CASE

(71) Applicant: John Preston, Silverwater (AU)

(72) Inventor: John Preston, Silverwater (AU)

( * ) Notice: Subject to any disclaimer, the term of this patent is extended or adjusted under 35 U.S.C. 154(b) by 0 days.

(21) Appl. No.: 14/767,239

(22) PCT Filed: Feb. 11, 2014

(86) PCT No.: PCT/AU2014/000104
§ 371 (c)(1),
(2) Date: Aug. 11, 2015

(87) PCT Pub. No.: WO2014/121344
PCT Pub. Date: Aug. 14, 2014

(65) Prior Publication Data

US 2016/0002931 A1 Jan. 7, 2016

(30) Foreign Application Priority Data

Feb. 11, 2013 (AU) ..... 2013900424

(51) Int. Cl.
*E04F 11/00* (2006.01)
*E04F 11/035* (2006.01)
(Continued)

(52) U.S. Cl.
CPC ..... *E04F 11/035* (2013.01); *E04F 11/038* (2013.01); *E04F 11/04* (2013.01); *E04F 2011/0209* (2013.01); *E04F 2011/0218* (2013.01)

(58) Field of Classification Search
CPC ..... E04F 11/025; E04F 11/035; E04F 11/09; E04F 11/04; E04F 11/038; E04F 11/104; E04F 11/1041; E04F 11/02; E04F 11/0255; E04F 11/028; E04F 11/022
USPC ..... 52/182–183
See application file for complete search history.

(56) References Cited

U.S. PATENT DOCUMENTS 3,196,997 A * 7/1965 Hager ..... E04F 11/035 52/182
4,015,687 A * 4/1977 Dean ..... E04F 11/025 182/220

(Continued)

FOREIGN PATENT DOCUMENTS

AU 2007100780 9/2007
DE 202011002694 5/2011

(Continued)

OTHER PUBLICATIONS

International Search Report for PCT/AU2014/000104 dated Jul. 24, 2014.

(Continued)

*Primary Examiner* — Beth Stephan
(74) *Attorney, Agent, or Firm* — Stephen J. Weyer, Esq.; Stites & Harbison, PLLC

(57) ABSTRACT

A stair assembly comprising at least two stair modules with each connected to an adjacent module; the stair assembly comprising a first module having first and second side abutments and spanning therebetween a stair tread. There is at least one other abutment surface associated with said first and second side abutments and which provides a bearing surface to receive and retain an adjacent stair module. The second module includes a stair tread which when disposed adjacent the first module is disposed in an us elevated position relative to the stair tread of the first module, wherein the first and second stair module are interconnected via an auxiliary module.

21 Claims, 6 Drawing Sheets

(51) Int. Cl.

| | |
|---|---|
| ***E04F 11/038*** | (2006.01) |
| ***E04F 11/04*** | (2006.01) |
| *E04F 11/02* | (2006.01) |

(56) References Cited

U.S. PATENT DOCUMENTS

| | | | | | |
|---|---|---|---|---|---|
| 4,422,270 | A * | 12/1983 | Lapointe | E04F 11/1041 | 52/182 |
| 4,635,416 | A * | 1/1987 | Ayala | E04F 11/022 | 182/220 |
| 4,709,520 | A * | 12/1987 | Vochatzer | E04F 11/025 | 182/220 |
| 4,819,391 | A * | 4/1989 | Tassin | E04F 11/1041 | 52/182 |
| 4,881,351 | A * | 11/1989 | Hamm | E04F 11/038 | 52/182 |
| 5,205,093 | A * | 4/1993 | Schuette | E04F 11/025 | 52/182 |
| 5,293,722 | A * | 3/1994 | Reimann | E04F 11/035 | 52/182 |
| 5,636,483 | A * | 6/1997 | Wille | E04F 11/0255 | 182/228.1 |
| 5,667,199 | A * | 9/1997 | Hamm | E04F 11/181 | 256/59 |
| 5,778,610 | A * | 7/1998 | Berg | E04F 11/1041 | 52/105 |
| 5,791,101 | A * | 8/1998 | Wallace | E04F 11/108 | 248/247 |
| 5,806,254 | A * | 9/1998 | Bennett | E04F 11/035 | 248/300 |
| 5,899,032 | A * | 5/1999 | Buzby | E04F 11/1041 | 52/182 |
| 5,941,046 | A * | 8/1999 | Prather | E04F 19/0495 | 52/208 |
| 6,088,977 | A * | 7/2000 | Lawrence | E04F 21/26 | 52/105 |
| 6,230,454 | B1 * | 5/2001 | Meagher | E04F 11/108 | 52/182 |
| 6,295,772 | B1 | 10/2001 | Whitson | | |
| 6,758,016 | B2 * | 7/2004 | Gobeil | E04F 11/00 | 182/228.3 |
| 6,763,912 | B2 * | 7/2004 | Robinson | E04F 11/025 | 182/113 |
| 7,946,084 | B2 * | 5/2011 | Gibson | E04F 11/1043 | 52/182 |
| 2007/0017169 | A1 * | 1/2007 | Gibson | E04F 11/1043 | 52/182 |
| 2007/0144084 | A1 * | 6/2007 | Barry | B27M 3/12 | 52/187 |
| 2007/0234653 | A1 * | 10/2007 | Ringness | E04F 11/025 | 52/182 |
| 2009/0205267 | A1 * | 8/2009 | Prins | E04F 11/1041 | 52/105 |
| 2009/0266969 | A1 | 10/2009 | Costello et al. | | |
| 2012/0073902 | A1 * | 3/2012 | Honeycutt | E04F 11/025 | 182/113 |
| 2012/0304560 | A1 | 12/2012 | Hyams | | |

FOREIGN PATENT DOCUMENTS

| | | |
|---|---|---|
| EP | 0942144 | 9/1999 |
| FR | 604662 | 5/1926 |
| FR | 2572443 | 5/1986 |
| FR | 2725743 | 4/1996 |

OTHER PUBLICATIONS

Writen Opinion of the International Searching Authority for PCT/AU2014/000104 dated Jul. 24, 2014.

* cited by examiner

STAIR MODULES WHICH CO OPERATE TO FORM A TEMPORARY STAIR CASE

BACKGROUND

The present invention relates to stair case construction and more particularly relates to a stair module which co operates with similar or identical stair modules to form a stair case. The invention has been primarily developed in order to produce a relatively light weight stair module which allows assembly and dismantling of stair cases which are particularly useful for temporary stair casing as is often used on building sites. Although the invention to be described herein has other applications it will be primarily described with reference to its application in the construction of temporary stairs for use in the construction industry. However, it should be appreciated that the invention is not limited to this particular mode and field of use and can be employed in more permanent stairways. The invention further relates to a module for construction of stairs which can be used in any application in which stairways are required for permanent or temporary purposes such as but not limited to temporary event structures including outdoor structures and grandstands for concerts and the like.

PRIOR ART

There are in existence a variety of modular stair assemblies used in the construction industry including modules for use in temporary stair cases. Various stairway kits for assembly of stairways have been in existence for many years. Among the known stair modules are those made from timber. A disadvantage of such timber modules is that they cannot be re used. Various other stair modules have been described in published patent applications such as AU2010100874 and PCT/EP2010/067776 and AU2007100780 which are incorporated by reference herein. Stair modules have been provided in kit form for the purpose of assembly on sites which require temporary stairways such as on constructions sites. They are used for access between levels in temporary scaffolding.

Stair case kits have been used for assembly in domestic dwellings. Traditionally space measurements determine the number of treads, riser height to fit the available space. The process of measuring, designing and manufacturing a staircase in this way can take a long time, perhaps up to six weeks. An alternative to a measured and made staircase of this type is to use a prefabricated staircase. However, such prefabricated staircases are only manufactured in a small range of sizes and are thus not suitable for all buildings. Stair case systems are known which permit a staircase to the manufactured and installed quickly in any building, regardless of the vertical distance between the downstairs and upstairs floors to be joined by the staircase. One such system a kit for assembling to produce a staircase, which includes a pair of stair supports, a plurality of tread supports for supporting treads when the staircase is assembled and means defining the correct position of the plurality of tread supports on the stair supports to produce a staircase to a given specification. The kit provides all of the components required to assemble a staircase which complies with building regulations. The means defining the correct position of the plurality of tread supports on the stair supports may comprise a template.

Although there have been a number of attempts at providing modules for internal stair cases they are not adaptable to all stair case locations and environments. On construction sites temporary stair cases must be strong and durable. Installing temporary stair cases by known methods is labour intensive and costly particularly as current temporary stair cases are not suitable for re use. This is a costly waste of material and requires more labour. There is a long felt want in the industry to provide an efficient method for assembly of temporary stair cases for use on building sites where temporary stairs are required.

INVENTION

The present invention provides an alternative to the known prior art and the shortcomings identified. The foregoing and other objects and advantages will appear from the description to follow. In the description reference is made to the accompanying representations, which forms a part hereof, and in which is shown by way of illustration specific embodiments in which the invention may be practiced. These embodiments will be described in sufficient detail to enable those skilled in the art to practice the invention, and it is to be understood that other embodiments may be utilised and that structural changes may be made without departing from the scope of the invention. The following detailed description is, therefore, not to be taken iii a limiting sense, and, the scope of the present invention is best defined by the appended claims.

The examples referred to herein are illustrative and are not to be regarded as limiting the scope of the invention. While various embodiments of the invention will be described herein, it will be appreciated that these are capable of modification, and therefore the disclosures herein are not to be construed as limiting of the precise details set forth, but to avail such changes and alterations as fall within the purview of the description. It is an object of the present invention to substantially overcome or at least ameliorate one or more of the above prior art disadvantages. Accordingly, in a first aspect, the present invention provides a module for use in the construction of a stair assembly manufactured from a plurality of like modules allowing ease of assembly and disassembly.

In its broadest form the present invention comprises:
a stair assembly comprising at least two stair modules with each connected to an adjacent module; the stair assembly comprising a first module having first and second side abutments and spanning therebetween a stair tread; at least one other abutment surface associated with said first and second side abutments and which provides a bearing surface to receive and retain an adjacent stair module, the second module including a stair tread which when the adjacent stair module is disposed in an elevated position relative to the stair tread of the first module when the second module engages the abutment surface of the first module.

According to a preferred embodiment each module is connected to an adjacent module via said auxiliary abutments. According to a preferred embodiment each module comprises first and second abutments which receive and retain, an end of a stair tread within a recess defined by the abutment. Each abutment preferably comprises a cubic formation manufactured from opposing angle sections arranged to define an internal space which retains an end of the stair tread.

In another broad form the present invention comprises:
a stair assembly comprising at least two stair modules; the stair assembly comprising a first module having first and second side abutments and spanning therebetween a stair tread whose first and second ends are respectively connected to said first and second side abutments; each side abutment including at least one abutment surface which provides a connecting surface to receive and retain an adjacent stair module, a second module of said at least two stair modules including a stair tread which when disposed adjacent the first stair module is disposed in an, elevated position relative to the stair tread of the first module, wherein the first and second stair module are interconnected via an auxiliary module which provides a bearing surface for the second module.

In another broad form the present invention comprises: a modular stair case manufactured from a plurality of like stair modules arranged in abutting relationship; each said module comprising;

first and second side abutments and spanning therebetween a stair tread; thin stair tread comprising a channel section terminating in first and second free ends; the abutments each comprising an outer wall and side walls defining a cubic formation forming an internal space which receives and retains one end of the stair tread.

According to a preferred embodiment the free ends of the stair tread are each connected to the side abutments via bolt fasteners.

In another broad form the present invention comprises: a stair module for use in the construction of a stair assembly comprising a plurality of like stair modules, each connected to an adjacent like module; each module comprising first and second side abutments and spanning therebetween a stair tread; the stair tread comprising a channel section terminating in first and second ends; the abutments each comprising an outer wall and side walls defining a cubic formation which receives and retains the stair tread.

According to a preferred embodiment each side abutment is connected to an adjacent abutment via an auxiliary abutment. This allows the modules to be cascaded as a typical rising stair case. The auxiliary abutment connected to said first and second side abutments provide a support surface to receive and retain first and second like stair modules, the second module including a stair tread which is disposed in an elevated position relative to the stair tread of the first module when the second module is located on the auxiliary abutments.

In another broad form the present invention comprises: a method of assembly of a modular stair assembly, comprising a plurality of like modules;

the method comprising the steps of;

a) providing a stair module comprising first and second side abutments and spanning therebetween a stair tread; the stair tread comprising a channel section terminating in first and second ends; the abutments each comprising an outer wall and side walls defining a cubic formation which receives and retains the stair tread;

b) attaching a plurality of said modules to each other in cascading relationship so as to form a modular stair assembly.

The method comprises the further step of attaching an auxiliary abutment member to the side abutment members of the first module and attaching a second module to the auxiliary abutment so that the first and second modules are arranged in cascading relationship.

The present invention provides an alternative to the known prior art and the shortcomings identified. The foregoing and other objects and advantages will appear from the description to follow. In the description reference is made to the accompanying representations, which forms a part hereof, and in which is shown by way of illustration specific embodiments in which the invention may be practiced. These embodiments will be described in sufficient detail to enable those skilled in the art to practice the invention, and it is to be understood that other embodiments may be utilised and that structural changes may be made without departing from the scope of the invention. The following detailed description is, therefore, not to be taken in a limiting sense, and the scope of the present, invention is best defined by the appended claims.

BRIEF DESCRIPTION OF DRAWINGS

The present invention will now be described in more detail according to a preferred but non limiting embodiment and with reference to the accompanying drawings wherein.

DETAILED DESCRIPTION

The examples referred to herein are illustrative and are not to be regarded as limiting the scope of the invention. While various embodiments of the invention have been described herein, it will be appreciated that these are capable of modification, and therefore the disclosures herein are not to be construed as limiting of the precise details set forth, but to avail such changes and alterations as fall within the purview of the description. Although the method and apparatus aspects of the invention will be described with reference to their application to heavy building construction, it will be appreciated that the invention has alternative applications.

Figure 1:
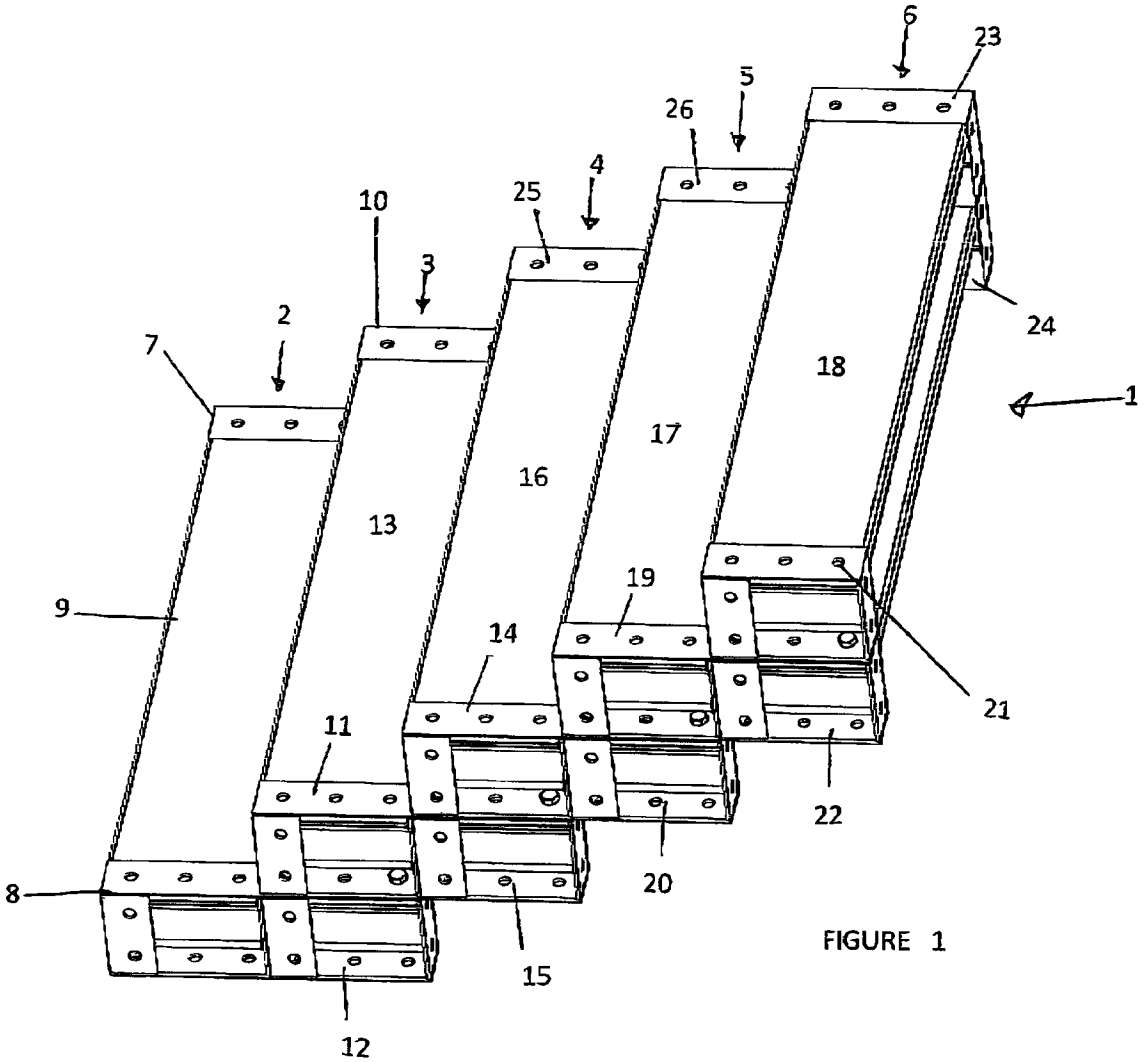
FIG. 1 shows an assembled perspective view of a module stair assembly according to a preferred embodiment.

Referring to FIG. 1 there is shown an assembled perspective view of a module stair assembly 1 according to a preferred embodiment. Stair assembly 1 comprises a plurality of like modules 2, 3, 4, 5, 6 each connected to an adjacent module. Module 2 comprises side abutments 7 and 8 and spanning therebetween a stair tread 9. Side abutments 7 and 8 are preferably manufactured from co operating angle sections which are arranged to form a preferably rectangular or square cubic member. Module 3 comprises side abutments 10 and 11 and spanning therebetween a stair tread 13. Engaging side abutments 8 and 11 of respective modules 2 and 3 is auxiliary abutment 12 which provides a bearing support for abutment 11 of module 3. The stair tread 13 of the second module 3 is as a result of abutment 12 disposed in an elevated position relative to the stair tread 9 of the first module 2 when the abutment 11 of second module 3 is located on the auxiliary abutment 12. A similar arrangement exists on the opposite side of module 3 in that abutments 7 and 10 are supported by an auxiliary abutment (obscured) in alignment with abutment 12. The aforesaid interengagements between abutments 8 and 11 of modules 2 and 3 and auxiliary abutment 12 is repeated each time a further module is added to the stair assembly. Module 4 includes side abutment 14 which receives an end of tread 16 and defines a recess with abutment 11 to receive and retain therein auxiliary support abutment 15. Module 5 includes side abutment 19 which receives an end of tread 17 and defines a recess with abutment 15 to receive and retain therein auxiliary support abutment 20. Module 6 includes side abutment 21 which receives an end of tread 18 and defines a recess with abutment 20 to receive and retain therein auxiliary support abutment 22. Module 6 includes on an opposite side of tread 18 a side abutment 23 which is supported by auxiliary abutment 24. Modules 4 and 5 have at their opposite ends abutments 25 and 26 which are supported by auxiliary abutments (obscured) similar to abutment 24.

Figure 2:
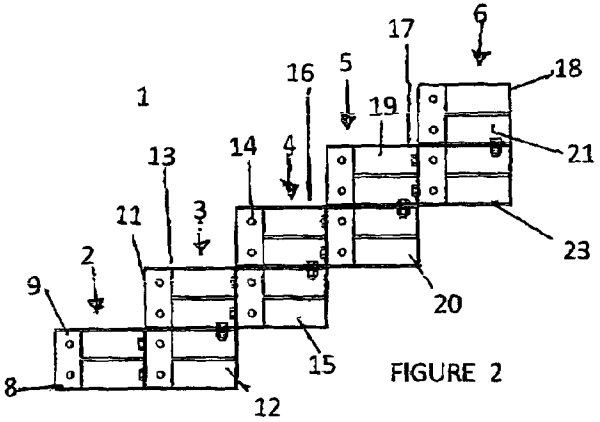
FIG. 2 shows a side elevation view of, the modular stair assembly of FIG. 1.
Figure 4:
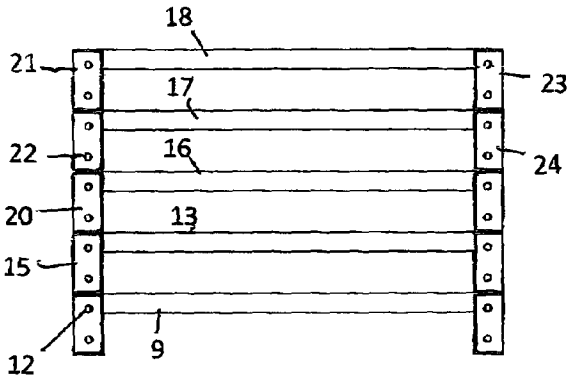
FIG. 4 shows an end elevation view of the stair assembly of FIG. 1.
Figure 5:
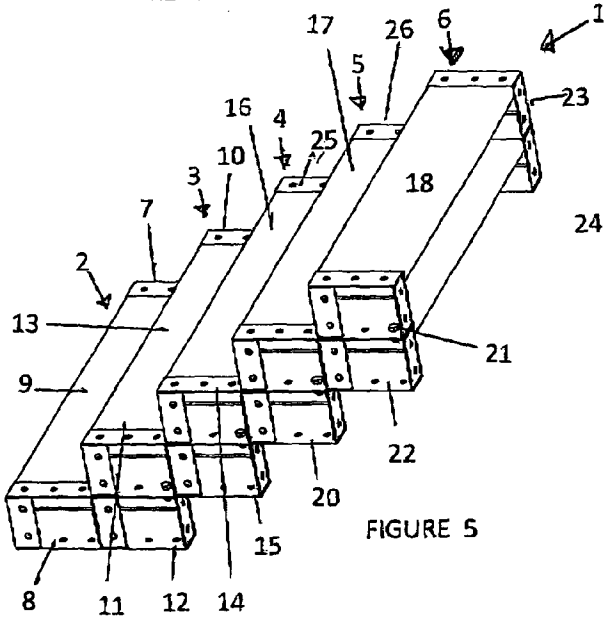
FIG. 5 shows an alternative perspective view of the stair assembly of FIG. 1 connected.
Figure 3:
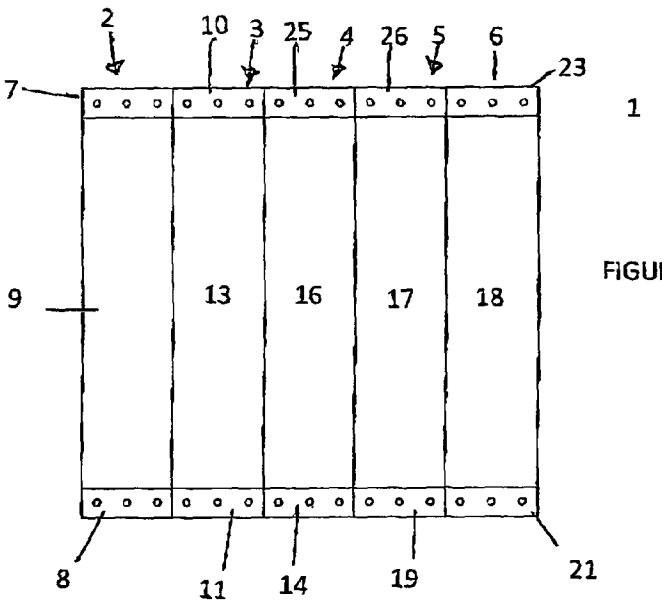
FIG. 3 shows a plan view of the stair assembly of FIG. 1.

FIG. 2 shows a side elevation view of the modular stair assembly of FIG. 1 with corresponding numbering. FIG. 3 shows with corresponding numbering a plan view of the stair assembly of FIG. 1. FIG. 4 shows with corresponding numbering an end elevation view of the stair assembly of FIG. 1. FIG. 5 shows with corresponding numbering an alternative perspective view of the stair assembly of FIG. 1 connected.

Figure 6:
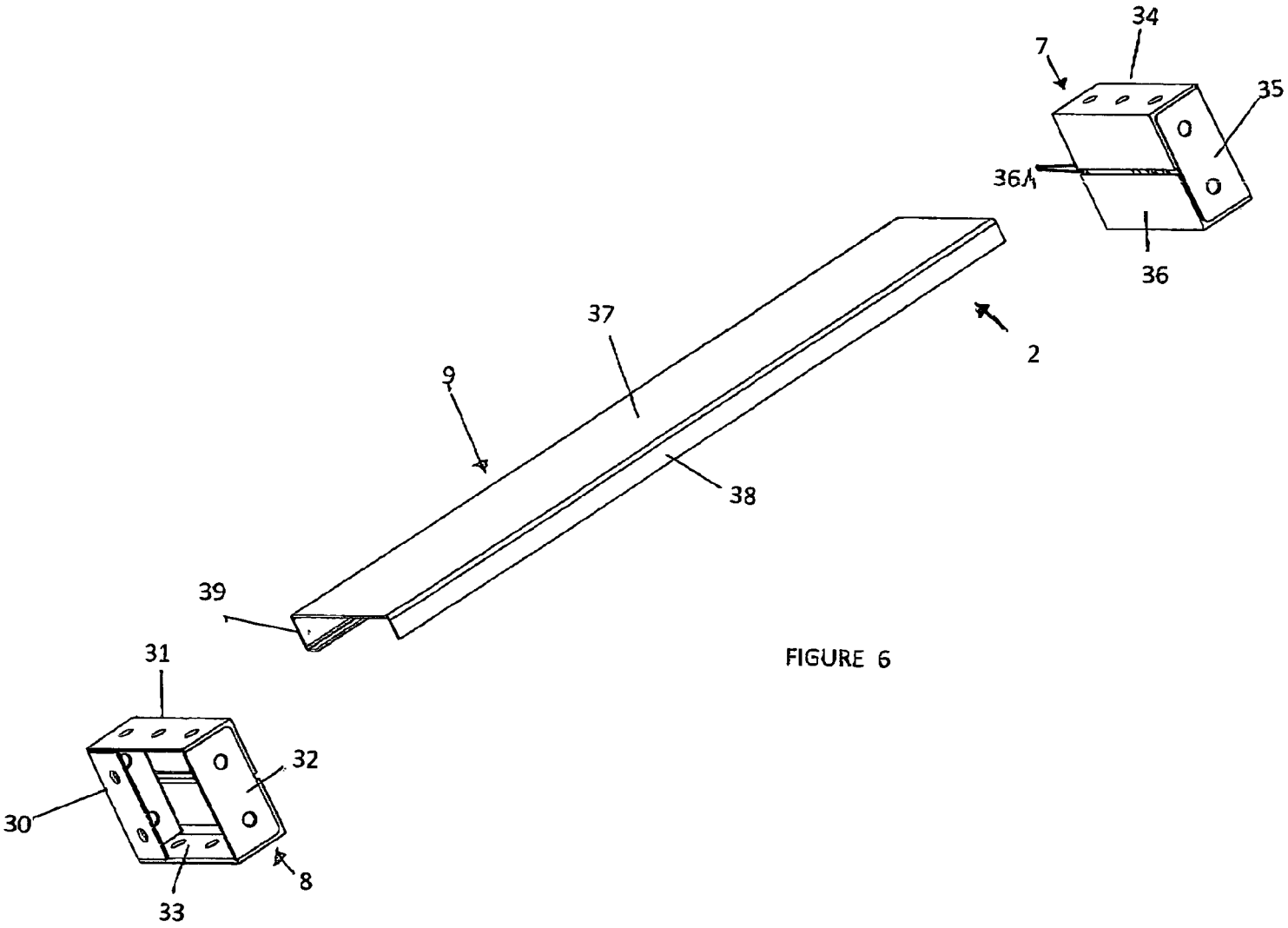
FIG. 6 shows an exploded view of a stair module according to a preferred embodiment.

FIG. 6 shows an exploded view of the module 2 and comprises abutments 7 and 8 and spanning therebetween a stair tread 9. Abutment 8 according to the embodiment shown comprises co operating plate or angle sections 30, 31, 32 and 33. Abutment 7 has similar construction including angle sections 34, 35, 36 and 36*a*. Tread 9 spans therebetween and is preferably manufactured as a channel section including a web 37 which forms the walking surface of the stair module and flanges 38 and 39 which act as stiffeners. Tread 9 can have a variety of spans depending upon requirements in each application for the stair assembly. Likewise the size of the selected angle profile sued for manufacture of the abutments 7 and 8 can be varied according to loading requirements. Also both equal and unequal angle sections can be used as required. In general the width of the stair walking surface 37 will determine the length of the angle sections. Likewise the riser height of each stair will dictate the length of the angle used to form the riser. According to a preferred embodiment the sides and therefore the angle lengths will be similar or the same as the riser height and walking surface width. Although angle and channel sections are preferred for manufacture of the abutments and stair tread respectively, it will be appreciated that alternative steel, plastics or aluminium sections may be used such as plate and box sections.

Figure 7:
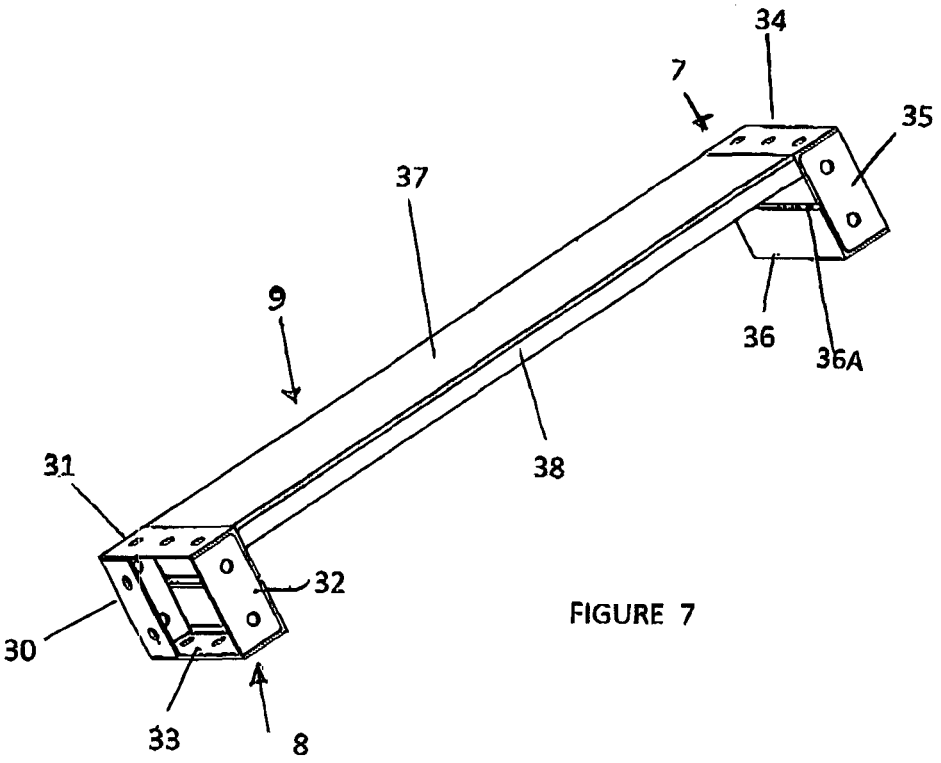
FIG. 7 shows an perspective view of the assembled stair module of FIG. 6.

FIG. 7 shows with corresponding numbering an assembled view of module 2 of FIG. 6. According to a preferred embodiment each module is connected to an adjacent module via the auxiliary abutments. According to a preferred embodiment each module comprises first and second abutments which receive and retain an end of a stair tread within a recess defined by the abutment. Each abutment preferably comprises a cubic formation manufactured from opposing angle sections arranged to define an internal space which retains an end of the stair tread.

Figure 8:
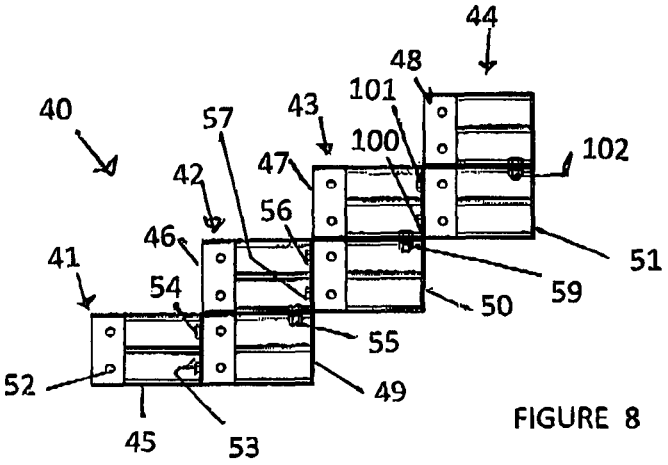
FIG. 8 shows a side elevation view of a stair assembly according to one embodiment.

FIG. 8 shows a side elevation view of a four stair module stair assembly 40 which employs seven separate stair modules. Stair assembly 40 includes four stair modules 41, 42, 43 and 44. Each of modules 41, 42, 43 and 44 have respective side abutments 45, 46, 47 and 48. Modules 46, 47 and 48 engage auxiliary modules 49, 50 and 51. Each module may be supplied singularly as for example module 41 or as a double module formed by fixation of modules 42 and 49. Modules 42 and 49 are fastened via bolts The stair assembly is preferably bolted in place by bolting each module to an adjacent module via the associated auxiliary module. Each abutment is adapted with a plurality of bolt openings 52 which are spaced apart retain fastening bolts. The array of fastening bolt openings 52 allow the module abutments to be interchanged and connected on each face of the abutments. In the embodiment shown abutment 45 is attached to auxiliary abutment 49 via bolts 53 and 54. Abutment of module 42 is attached to auxiliary abutment 49 via bolt 55. This bolting arrangement is repeated for each module such that abutment 46 is attached to auxiliary abutment 50 via bolts 56 and 57 and abutment module 47 is attached to auxiliary abutment 50 via bolt 59. Module 43 is connected to module 51 via bolts 100 and 101 and module 44 is connected to module 51 via bolt 102. Not all bolts used are shown but the number of bolts used are dictated by expected stair loadings. Each abutment has a plurality of aligned bolt holes which allow for different numbers of bolts depending upon requirements. The bolts resist shear forces applied when the stair assembly is constructed. Increased shear resistance can be obtained by increasing bolt numbers. The modularity of the construction of the stair assembly 40 allows for different tread widths and different riser heights. This would require selection of different angle section lengths when angles are used to from the side abutments and selection of a width of tread to be accommodated by the abutments.

Figure 9:
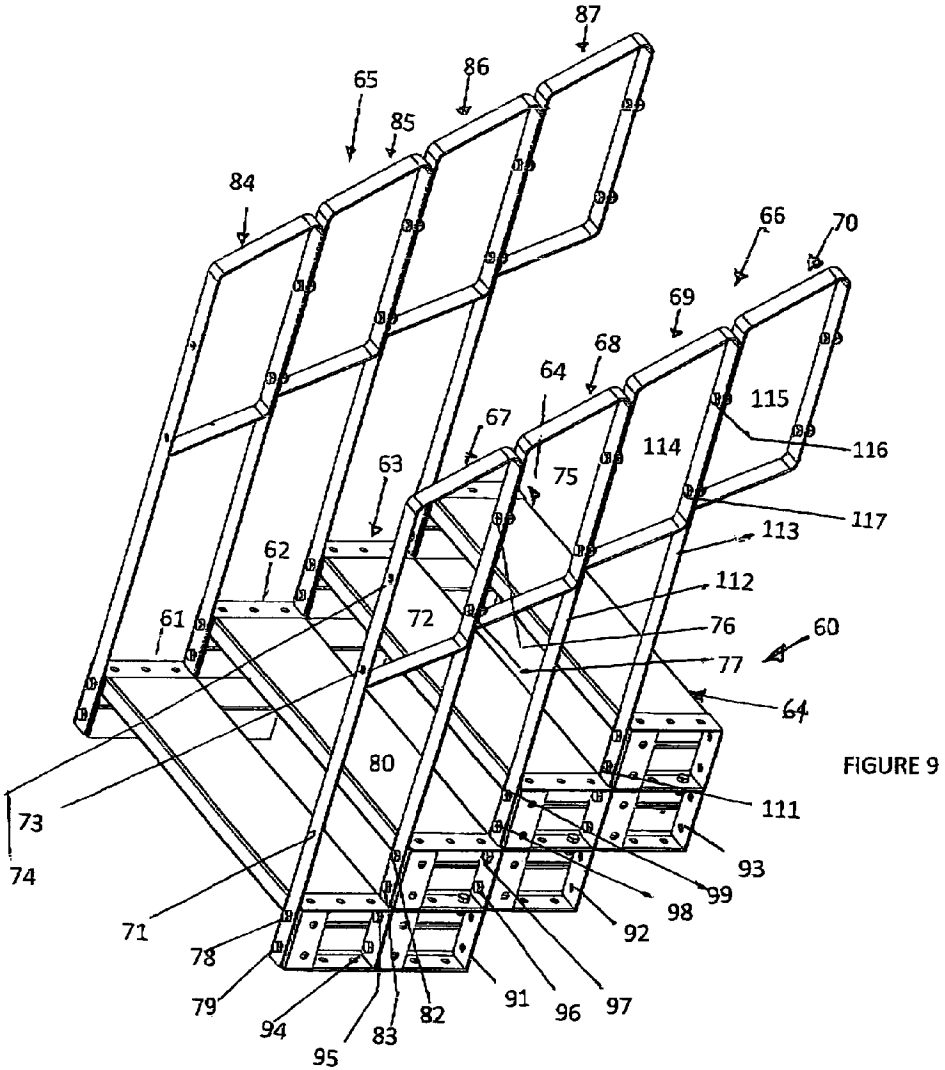
FIG. 9 shows a perspective view of a stair assembly comprising four modules and with detachable handrails fitted.

FIG. 9 shows a perspective view of a stair assembly 60 comprising four modules 61, 62, 63 and 64. Modules 62, 63 and 64 are supported by auxiliary modules 91, 92 and 93. Stair assembly 60 is constructed in a similar manner to that described as for module 40 of FIG. 8. The modules are bolted together. For example module 61 is bolted to auxiliary module 91 via bolts 94 and 95. Likewise module 62 is connected to auxiliary module 92 via bolts 96 and 97. Assembly 60 further comprises detachable handrails 65 and 66 fitted. The connection regime of the handrail modules will be described with reference to handrail 66 as handrail modules 84, 85, 86 and 87 are connected in like manner. Handrail 66 is itself constructed from a series of co operating hand rail modules 67, 68, 69 and 70. Hand rail module 67 is substantially P shaped and comprises a supporting strut 71 terminating in a loop 72. Strut 71 includes openings 73 and 74 which when the handrail modules are bolted together receives fastening bolts. Module 67 is connected to loop 75 of module 68 via bolts 76 and 77. Module 67 is connected to stair module 61 via strut 71 which is fastened by bolts 78 and 79. Similarly strut 8G of handrail module 68 is secured to stair module 62 via bolts 82 and 83. Handrail modules 69 and 70 are respectively connected to stair modules 63 via bolts 98 and 99 securing strut 112 and module 64 via bolts 110 and 111 securing strut 113. Loop 114 of handrail module 69 is connected to loop 115 of module 70 via bolts 116 and 117. In like manner handrail modules 84, 85, 86 and 87 are respectively connected to modules 61, 62, 63 and 64. The modularity of both the stair modules and handrail modules impart wide flexibility to individual stair assembly design which allows for different dimensions of modules and variations in load bearing capacity depending upon the gauge (primarily thickness) of material used and the number of shear bolts employed. Flat steel lengths are preferred for fabrication of the handrail modules. Although hand rail modules have been described as P shaped, it will be appreciated by persons skilled in the art that various other handrail configurations are feasible depending upon particular site or, application requirements.

Figure 10:
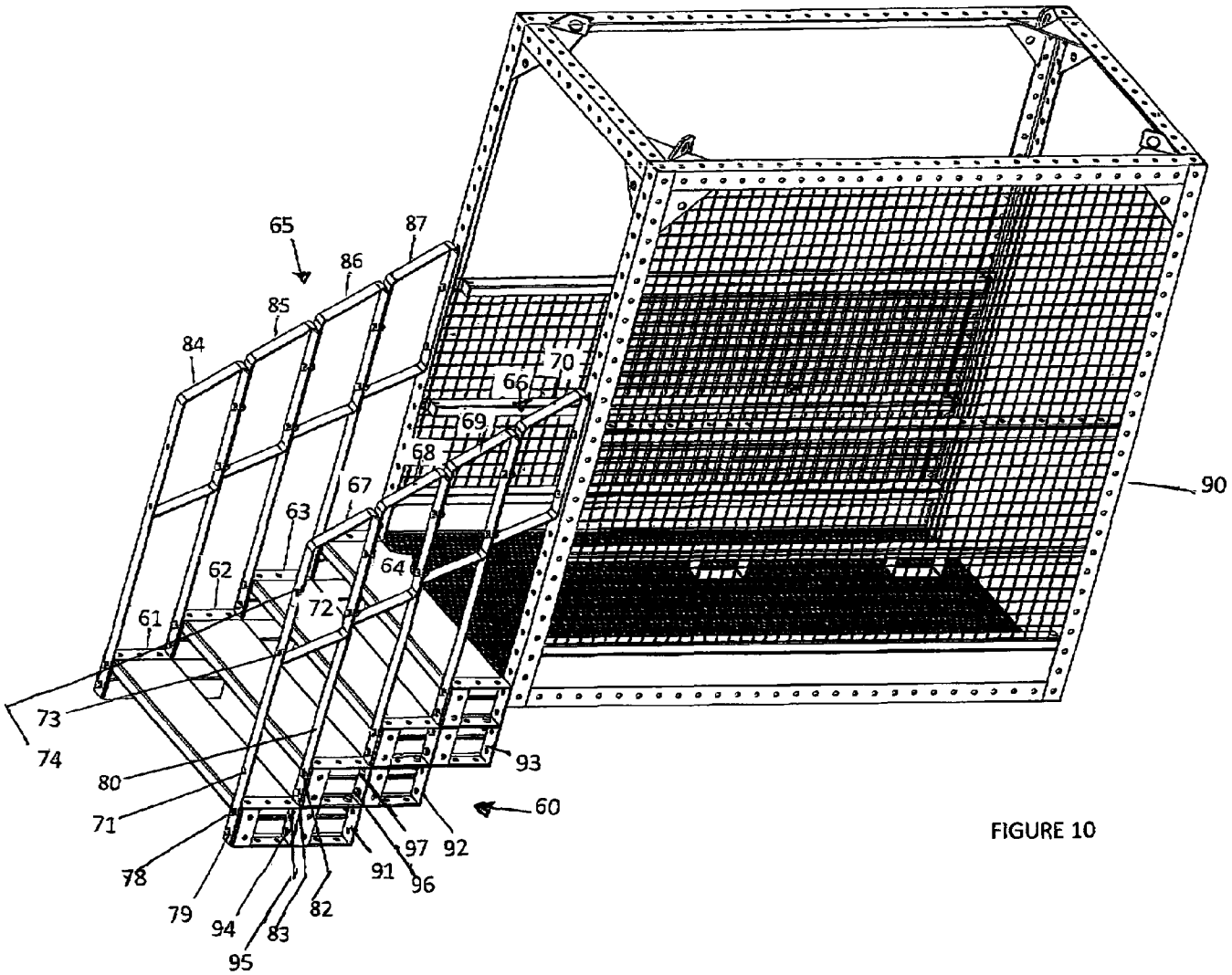
FIG. 10 shows the assembled stair assembly of FIG. 9 attached to a building scaffold.

FIG. 10 shows with corresponding numbering the assembled stair assembly 60 of FIG. 9 attached to a building scaffold 90. In this case the stair assembly is used as an approach to a walkway often found on a building site. This shows one example of the use of the stair assembly but it will be appreciated that it is adaptable for a variety of other applications where permanent or temporary stairs are required such as but not limited to building construction sites. Typically to construct a stair assembly a first ground engaging stair module is set in position. A like second ground engaging module is abutted against the first module and is bolted together via aligned bolt holes in the side abutments. A third module which will form a second stair is then attached on top of the second module via aligned bolt holes. The next module is then attached to the third module and this process is repeated depending upon how many stairs are required. Hand rails are then attached to the stair assembly as described earlier.

Although the invention has been described with reference to specific examples, it would be appreciated by those skilled in the art that the invention may be embodied in many other forms. Although the method and apparatus aspects of the invention have been described with reference to their application to modular stairs used in construction sites, it will be appreciated that the invention has alternative applications.

The stair modules described herein are preferably manufactured from steel but other materials may be employed such as heavy duty plastics materials and aluminium. One advantage of the invention described herein is that the connecting joint methodology imparts high strength with shear bolts which also provide high resistance to bending. Although the drawings show double bolt holes in each connection, it will be appreciated that a variety of bolt sizes (length and diameters) and bolt configurations can be employed depending upon stair loading requirements.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The claims defining the invention are as follows:

1. A stair assembly comprising a plurality of adjacent stair modules; each of the stair modules comprising first and second side abutments and spanning therebetween a stair tread having first and second ends respectively connected to said first and second side abutments; each of said side abutments including at least one abutment surface, the stair modules comprising at least first and second stair modules, the stair tread of the second stair module when disposed adjacent the first stair module is disposed in an elevated position relative to the stair tread of the first stair module, wherein the first and second stair modules are interconnected via auxiliary modules with each auxiliary module comprising a bearing surface for the second stair module and a contact surface for one of the stair modules, the side abutments of the second stair module supported on the bearing surfaces of the auxiliary modules, the contact surfaces of the auxiliary modules connected to the side abutments of the first stair module.

2. A stair assembly according to claim 1 wherein each of the modules comprises a recess defined by each said first and second side abutments, the recess receiving and retaining one of the ends of the stair tread within.

3. A stair assembly according to claim 2 wherein each module is connected to an adjacent module via opposing bearing surfaces on each module.

4. A stair assembly according to claim 3 wherein each abutment comprises a cubic formation manufactured from co-operating angle sections arranged to define said recess which retains one of the ends of the stair treads.

5. A stair assembly according to claim 4 wherein the angle sections have spaced apart bolt holes.

6. A stair assembly according to claim 5 wherein the first and second ends of the stair treads are each connected to the side abutments via bolt fasteners engaging said bolt holes.

7. A stair assembly according to claim 6 wherein each side abutment of one of the modules is connected to one of the side abutments of another one of the modules via one of the auxiliary modules.

8. A stair assembly according to claim 7 wherein one stair tread of one module is disposed in an elevated position relative to the stair tread of an adjacent module when a plurality of stair modules are engaged.

9. A stair assembly according to claim 8 wherein two steps are formed using two stair modules and one auxiliary module.

10. A stair assembly according to claim 9 wherein each stair tread is formed from a channel shaped section.

11. A stair assembly according to claim 10 wherein, the side abutments of each module are manufactured from connected lengths of equal angle sections.

12. A stair assembly according to claim 11 wherein, the abutments are either square or rectangular.

13. A stair assembly according to claim 12 wherein, each module having the stair tread has connected thereto a modular hand railing.

14. A stair assembly according to claim 13 wherein, each modular hand railing has a first end connected via at least one fastener to one of the stair modules and a second end terminating in a member for hand gripping.

15. A stair assembly according to claim 14 wherein, each modular railing is connected to an adjacent modular hand railing.

16. A stair assembly according to claim 15 wherein each modular hand railing is P shaped.

17. A stair module for use in the construction of a stair assembly formed from at least two said stair modules, each module comprising first and second side abutments and spanning therebetween a stair tread; the stair tread terminating in first and second ends; the side abutments each comprising an end wall and side walls defining a cubic formation forming an internal space which receives and retains one of the ends of the stair tread;

wherein, the side abutments of each module are comprised of adjacent L-shaped sections; and wherein each L-shaped section is, when connected to form the side abutments, disposed normally to one of the adjacent L-shaped sections.

18. A stair module according to claim 17 wherein the side abutments include an array of openings which receive fasteners which enable fastening of the stair treads to said side abutments and one module to an adjacent auxiliary module.

19. A stair module according to claim 18 wherein the side abutments of the stair modules are manufactured from joined angle sections which include spaced apart openings for said bolts.

20. A stair module according to claim 19 wherein the stair tread comprises a channel section.

21. A method of assembly of a modular stair assembly, comprising a plurality of stair modules;

the method comprising the steps of:

a) providing the stair modules, each of the modules comprising first and second side abutments and spanning therebetween a stair tread; the stair tread comprising a channel section terminating in first and second ends; the side abutments each comprising an outer wall and side walls defining a cubic formation forming an internal space which receives and retains the stair tread;

b) providing auxiliary modules each having a vertical contacting surface and a horizontal bearing surface; and c) attaching the contact surfaces of one of the auxiliary modules to the side abutments of a first one of said modules, and attaching the side abutments of a second one of the modules to the bearing surfaces of the one of the auxiliary modules such that the first and second modules are in cascading relationship.

* * * * *